US007942685B2

(12) United States Patent
Cho et al.

(10) Patent No.: US 7,942,685 B2
(45) Date of Patent: May 17, 2011

(54) LAMP SOCKET, DISPLAY APPARATUS INCLUDING THE SAME, AND METHOD OF ASSEMBLING LAMP

(75) Inventors: Joo-Woan Cho, Asan-si (KR); Seong-Sik Choi, Seoul (KR)

(73) Assignee: Samsung Electronics Co., Ltd. (KR)

( * ) Notice: Subject to any disclaimer, the term of this patent is extended or adjusted under 35 U.S.C. 154(b) by 135 days.

(21) Appl. No.: 12/361,519

(22) Filed: Jan. 28, 2009

(65) Prior Publication Data

US 2009/0191741 A1 Jul. 30, 2009

(30) Foreign Application Priority Data

Jan. 29, 2008 (KR) ..... 2008-0008978

(51) Int. Cl.
*H01R 33/02* (2006.01)

(52) U.S. Cl. ..... 439/239

(58) Field of Classification Search ..... 439/239, 439/228, 232, 242, 235, 241; 362/296; 315/224
See application file for complete search history.

(56) References Cited

U.S. PATENT DOCUMENTS

| | | | | |
|---|---|---|---|---|
| 6,309,236 | B1 | 10/2001 | Ullrich | |
| 6,343,942 | B1 * | 2/2002 | Okamoto | 439/110 |
| 2006/0202622 | A1 | 9/2006 | Lung et al. | |
| 2007/0298662 | A1 | 12/2007 | Kim | |
| 2008/0124950 | A1 * | 5/2008 | Yuan et al. | 439/56 |

FOREIGN PATENT DOCUMENTS

| | | | |
|---|---|---|---|
| CN | 200987024 | Y | 12/2007 |
| EP | 2006726 | A1 | 12/2008 |
| JP | 0703487 | A | 1/1995 |
| JP | 07025579 | A | 1/1995 |

* cited by examiner

*Primary Examiner* — Alexander Gilman
(74) *Attorney, Agent, or Firm* — Innovation Counsel LLP

(57) ABSTRACT

A lamp socket includes a power-up device including a conductive material and supplying power to a lamp electrode, and a housing receiving the power transmitting member. The power transmitting member includes an inverter connector, a first lamp electrode supporter, and an terminal unit. The first lamp electrode supporter is connected to the inverter connector and formed with a lamp electrode receiving section into which the lamp electrode is inserted. The terminal unit has a fixed terminal connected to the first lamp electrode supporter, a free-end terminal supporting the lamp electrode such that the lamp electrode adheres to the lamp electrode receiving section, and a connection terminal that connects the fixed terminal to the free-end terminal in the housing.

20 Claims, 5 Drawing Sheets

LAMP SOCKET, DISPLAY APPARATUS INCLUDING THE SAME, AND METHOD OF ASSEMBLING LAMP

CROSS-REFERENCE TO RELATED APPLICATION

This application claims priority to and the benefit of Korean Patent Application No. 2008-8978 filed on Jan. 29, 2008, the contents of which are herein incorporated by reference in their entirety.

BACKGROUND

1. Field of the Invention

One or more embodiments of the present invention generally relate to a lamp socket, a display apparatus having the same, and a method of assembling a lamp. More particularly, one or more embodiments of the present invention relate to a lamp socket having a thin thickness, a display apparatus having the same, and a method of assembling a lamp.

2. Description of the Related Art

The importance of display apparatuses used to display information is ever increasing in the modern society. Recently, various types of display apparatuses have been developed and utilized in various fields.

Among the display apparatuses, flat panel displays have proliferated as electronic appliances. A representative flat panel display is a liquid crystal display (LCD) that displays an image by using electrical and optical characteristics of liquid crystal. The LCD has a slim structure and light weight. In addition, the LCD has low power consumption and operates at low driving voltage. These and other advantages of LCD have allowed the LCD to be extensively used in various industrial fields.

The LCD includes a liquid crystal display panel, a driving circuit unit used to drive the liquid crystal display panel, and a backlight unit that provides light to the liquid crystal display panel.

In a conventional direct-illumination type backlight unit, in order to affix a lamp to the backlight unit, a lamp lead wire is connected to a lamp socket by soldering a wire onto the lamp lead wire and then the lamp socket is connected to an inverter by using a connector. That is, in order to assemble the conventional direct-illumination type backlight unit, the wire is manually soldered onto the lamp lead wire to connect the lamp lead wire to the lamp socket and then the connector is coupled to the lamp socket. If the direct-illumination type backlight unit is manually assembled as described above, the quality of the direct-illumination type backlight unit may vary depending on the skill of a worker. Manual assembly also results in increased manufacturing cost due to increased labor cost.

SUMMARY

One or more embodiments of the present invention generally provide a lamp socket having a thin thickness and a structure to facilitate assembling work.

One or more embodiments of the present invention also generally provide a display apparatus having the lamp socket.

One or more embodiments of the present invention also generally provide a method of assembling a lamp for the display apparatus.

According to an exemplary embodiment of the present invention, a lamp socket may include a power transmitting member and a housing. The power transmitting member includes a conductive material and supplies a power to a lamp electrode. The housing receives the power transmitting member therein. The power transmitting member includes an inverter connector, a first lamp electrode supporter, and an terminal unit. The first lamp electrode supporter is connected to the inverter connector and comprising a lamp electrode receiving section into which the lamp electrode is inserted. The terminal unit has a fixed terminal connected to the first lamp electrode supporter, a free-end terminal supporting the lamp electrode to be adhered to the lamp electrode receiving section, and a connection terminal that connects the fixed terminal to the free-end terminal in the housing.

In accordance with another embodiment of the present invention for the lamp socket, the highest point of the free-end terminal is located below the highest point of the fixed terminal.

In accordance with another embodiment of the present invention for the lamp socket, the connection terminal is bent in the housing to connect the fixed terminal to the free-end terminal.

In accordance with another embodiment of the present invention for the lamp socket, the lamp electrode receiving section includes an insertion guide, a fixing groove and a slope. The insertion guide guides the lamp electrode when the lamp electrode is inserted into the lamp electrode receiving section. The fixing groove is connected to the insertion guide and has a curvature section corresponding to a diameter of the lamp electrode. The slope is connected to the fixing groove to support the lamp electrode. The lamp socket may include an interval adjuster positioned at a tip of the free-end terminal to adjust an interval between the free-end terminal and the insertion guide.

In accordance with another embodiment of the present invention for the lamp socket, the free-end terminal may include a lamp grip section that makes contact with the lamp electrode while surrounding the lamp electrode.

In accordance with another embodiment of the present invention, the lamp socket may include a second lamp electrode supporter that is spaced apart from the first lamp electrode supporter and formed with the lamp electrode receiving section.

According to an exemplary embodiment of the present invention, a display apparatus may include a display panel, a backlight assembly, and a chassis. The display panel displays an image. The backlight assembly includes a lamp that supplies light to the display panel, and a lamp socket that supplies power to a lamp electrode. The lamp is affixed to the lamp socket. The chassis receives the backlight assembly therein. The lamp socket includes a power transmitting member and a housing receiving the power transmitting member. The power transmitting member includes an inverter connector, a first lamp electrode supporter, and an terminal unit. The first lamp electrode supporter is connected to the inverter connector and comprising a lamp electrode receiving section into which the lamp electrode is inserted. The terminal unit comprises a fixed terminal connected to the first lamp electrode supporter, a free-end terminal supporting the lamp electrode to be adhered to the lamp electrode receiving section, and a connection terminal that connects the fixed terminal to the free-end terminal in the housing.

In accordance with another embodiment of the present invention for the display apparatus, the highest point of the free-end terminal is located below the highest point of the fixed terminal.

In accordance with another embodiment of the present invention for the display apparatus, the connection terminal is bent in the housing to connect the fixed terminal to the free-end terminal.

In accordance with another embodiment of the present invention for the display apparatus, the lamp electrode receiving section may include an insertion guide, a fixing groove, and a slope. The insertion guide guides the lamp electrode when the lamp electrode is inserted into the lamp electrode receiving section. The fixing groove is connected to the insertion guide and has a curvature section corresponding to a diameter of the lamp electrode. The slope is connected to the fixing groove to support the lamp electrode. The display apparatus may include an interval adjuster positioned at a tip of the free-end terminal to adjust an interval between the free-end terminal and the insertion guide.

In accordance with another embodiment of the present invention for the display apparatus, the free-end terminal may include a lamp grip section that makes contact with the lamp electrode while surrounding the lamp electrode.

In accordance with another embodiment of the present invention, the display apparatus may include a second lamp electrode supporter that is spaced apart from the first lamp electrode supporter and formed with the lamp electrode receiving section.

In accordance with another embodiment of the present invention for the display apparatus, the chassis may comprise a coupling hole into which the lamp socket is inserted.

According to an exemplary embodiment of the present invention, a method of assembling a lamp is provided as follows. First, the lamp having a lamp electrode and a lamp socket comprising a housing and a power transmitting member are prepared. The power transmitting member may include an inverter connector, a lamp electrode supporter formed with a lamp electrode receiving section, and an terminal unit having a fixed terminal, a free-end terminal, and a connection terminal. Then, an interval between the terminal unit and the lamp electrode receiving section is expanded by moving the terminal unit. After that, the lamp electrode is inserted into the lamp electrode receiving section and the terminal unit is elastically moved such that the terminal unit can make contact with the lamp electrode.

In accordance with another embodiment of the present invention for the method of assembling the lamp, the highest point of the free-end terminal is located below the highest point of the fixed terminal.

In accordance with another embodiment of the present invention for the method of assembling the lamp, the terminal unit may include an interval adjuster formed at a tip of the free-end terminal. The interval adjuster is moved and then fixed by a jig such that an interval between the free-end terminal and the lamp electrode receiving section is expanded.

In accordance with another embodiment of the present invention for the method of assembling the lamp, the connection terminal applies elastic force to the free-end terminal such that the free-end terminal makes contact with the lamp electrode to support the lamp electrode.

According to the above exemplary embodiments of the present invention, the lamp socket is made thin so that the thickness of the display apparatus may be reduced. In addition, the lamp electrode does not protrude, thereby preventing the display apparatus from being physically or electrically damaged by external impact.

BRIEF DESCRIPTION OF THE DRAWINGS

The above and other advantages of the embodiments of the present invention will become readily apparent by reference to the following detailed description when considered in conjunction with the accompanying drawings wherein.

DESCRIPTION OF THE EMBODIMENTS

Figure 1:
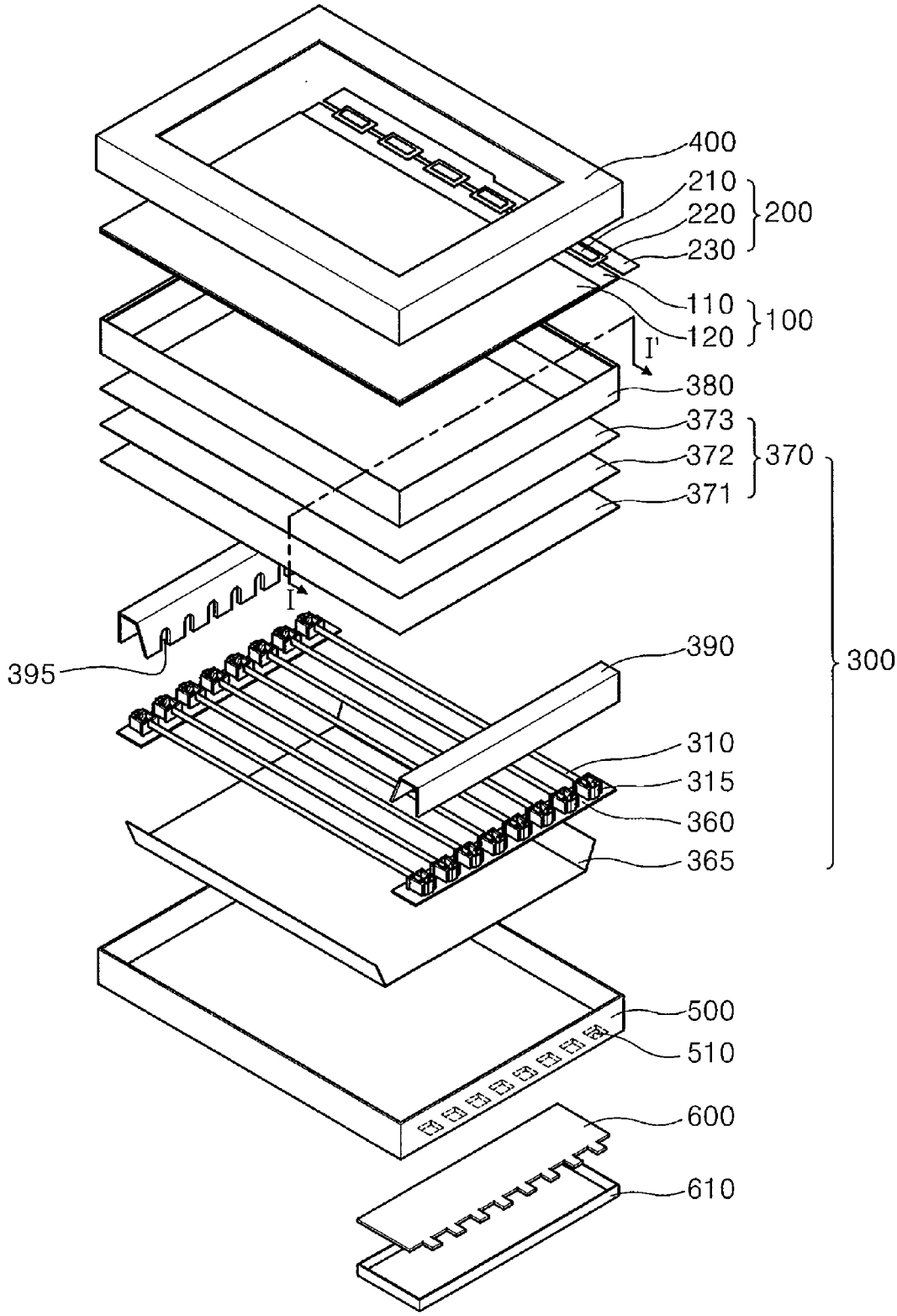
FIG. 1 is an exploded perspective view of a display apparatus according to one or more exemplary embodiments of the present invention.

It will be understood that when an element or layer is referred to as being "on", "connected to" or "coupled to" another element or layer, it may be directly on, connected to or coupled to the other element or layer, or intervening elements or layers may be present. In contrast, when an element is referred to as being "directly on," "directly connected to" or "directly coupled to" another element or layer, there are no intervening elements or layers present. Like reference numerals refer to like elements throughout. As used herein, the term "and/or" includes any and all combinations of one or more of the associated listed items.

It will be further understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" or "beneath" may encompass both an orientation of above and below. The device may be otherwise oriented (rotated 90 degrees or at other orientations) and the spatially relative descriptors used herein may be interpreted accordingly.

The terminology used herein is for the purpose of describing particular embodiments of the invention only and is not intended to be limiting of other embodiments of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as they are commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
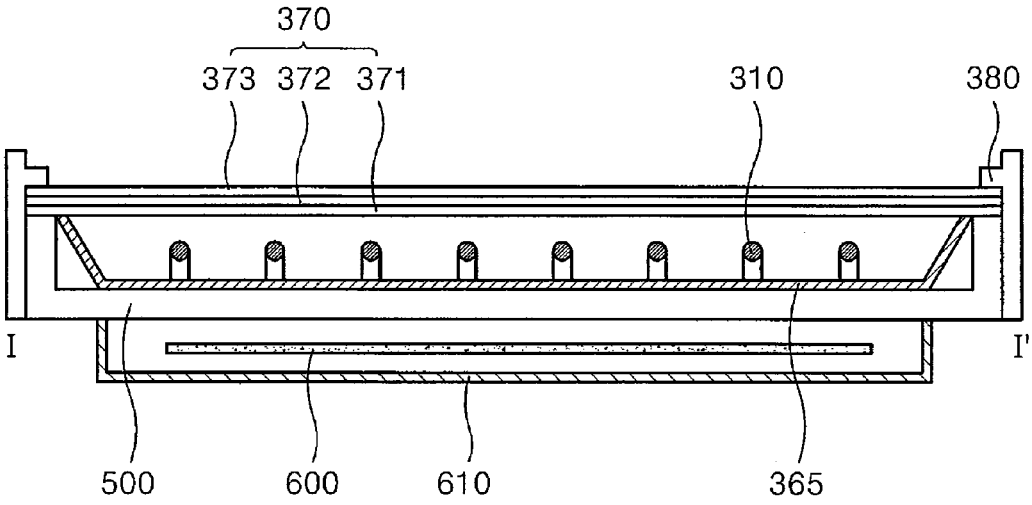
FIG. 2 is a cross-sectional view taken along line I-I' shown in FIG. 1.

FIG. 1 is an exploded perspective view of a display apparatus according to one or more exemplary embodiments of the present invention, and FIG. 2 is a cross-sectional view taken along line I-I' shown in FIG. 1.

Referring to FIGS. 1 and 2, a display apparatus may include a display panel 100, a panel driver 200, a backlight assembly 300, a top chassis 400 and a bottom chassis 500.

The display panel 100 receives light to display an image. To this end, the display panel 100 may include a first substrate 110, a second substrate 120, and liquid crystals (not shown) interposed between the first substrate 110 and the second substrate 120 capable of adjusting light transmittance between the two substrates.

The first substrate 110 may be an insulating substrate and may include a black matrix (not shown), a color filter (not shown) and a common electrode (not shown), which may be disposed on the insulating substrate.

The second substrate 120 may be an insulating substrate and may include a plurality of gate and data lines (not shown) aligned on the insulating substrate in the form of a matrix, thin film transistors (not shown) positioned in areas defined by the gate and data lines that cross each other, and pixel electrodes (not shown) connected to the thin film transistors.

The panel driver 200 drives the display panel 100 to display the image. The panel driver 200 may include a driving integrated circuit 210 mounted on a signal transmission substrate 220, and a driving circuit substrate 230 that supplies power and various signals to the display panel 100 through the signal transmission substrate 220.

The backlight assembly 300 may be positioned below the display panel 100 to supply the light to the display panel 100. The backlight assembly 300 may include lamps 310, lamp sockets 315, a reflective member 365, an optical sheet 370, a mold frame 380, and side molds 390.

Figure 4:
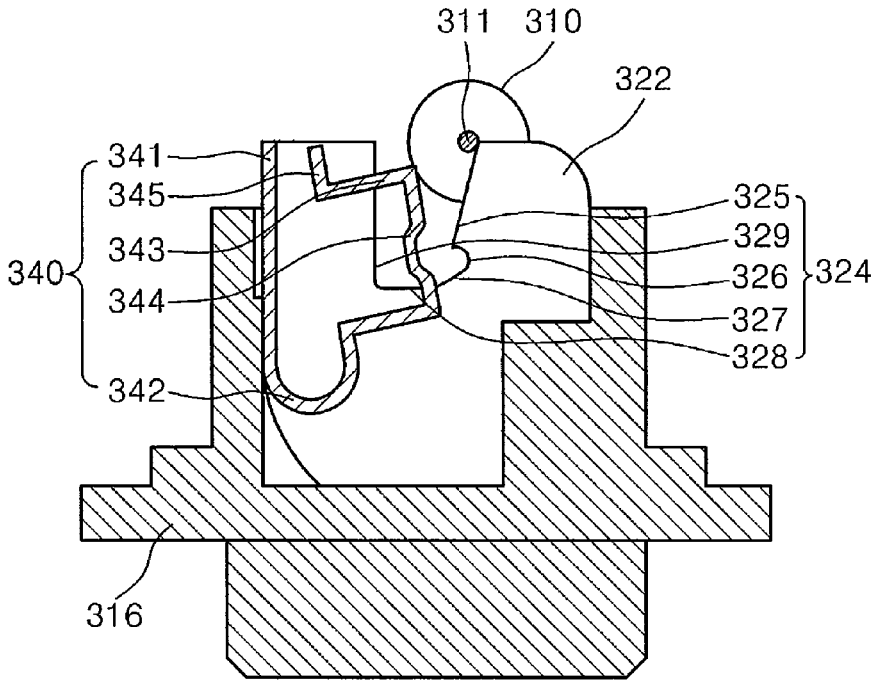
FIG. 4 is a cross-sectional view of a power transmitting member and a housing of the lamp socket shown in FIG. 3.

The lamps 310 generate light and supply the light to the display panel 100. For instance, the lamps 310 may include a CCFL (cold cathode fluorescent lamp), or an EEFL (external electrode fluorescent lamp), and may be connected to the lamp sockets 315. The lamps 310 may include lamp electrodes 311, such as shown in FIG. 4, which are provided at an outer portion of the lamps 310 to receive external power.

The lamp sockets 315 may be arranged at end portions of the lamps 310 to be affixed to the lamps 310 and to apply power to the lamps 310. In addition, the lamp sockets 315 may be connected to each other by a connector 360. The lamp sockets 315 will be described later in detail with reference to FIGS. 3 to 6.

The reflective member 365 may be positioned below the lamps 310 to reflect the light that is emitted downward from the lamps 310 back toward the lamps 310, thereby reducing light loss. To this end, the reflective member 365 may include a plate or a sheet having high light reflectivity.

The optical sheet 370 may include a diffusion sheet 371, a prism sheet 372, and a protective sheet 373. The diffusion sheet 371 diffuses the light emitted from the lamp 310 such that the light is uniformly incident on the display panel 100. The prism sheet 372 allows the light, which is diffused by the diffusion sheet 371, to be vertically incident on the display panel 100. The protective sheet 373 protects the prism sheet 372 such that the prism sheet 372 is prevented from being scratched. Two or three optical sheets 370 may be selectively employed according to the characteristics of the display apparatus.

The mold frame 380 receives the display panel 100 and protects the display panel 100, the lamps 310, the lamp sockets 315, the reflective member 365, and the optical sheet 370 from external impacts. To this end, the mold frame 380 may include a mold material such as plastic.

The side mold 390 may have mold grooves 395 that surround the lamps 310 to affix the lamps 310 to the side mold 390. In addition, the side mold 390 may have a predetermined height to support the optical sheet 370 so that the lamps 310 are spaced apart from the optical sheet 370 by a predetermined distance. The side mold 390 may be formed with a stepped portion that receives the optical sheet 370.

The top chassis 400 may be aligned above the display panel 100 to protect the display panel 100 and the backlight assembly 300 from external impacts. The top chassis 400 may be formed at the center thereof with an opening to expose the display area of the display panel 100. The top chassis 400 may surround an outer peripheral portion of the display panel 100.

The bottom chassis 500 may be aligned below the backlight assembly 300 to receive the backlight assembly 300. The bottom chassis 500 may be formed at one side thereof with coupling holes 510 into which the lamp sockets 315 are inserted. The number of coupling holes 510 may correspond to the number of lamp sockets 315.

The display apparatus may further include an inverter 600 that supplies power to the lamps 310, and a protective cover 610 that protects the inverter 600 and the lamp sockets 315. The inverter 600 may be mounted on the bottom of the bottom chassis 500 and may be connected to the lamp sockets 315 to supply power to the lamps 310. The protective cover 610 may be coupled with the bottom of the bottom chassis 500 to protect the inverter 600 connected to the lamp sockets 315 from external impacts. For instance, the protective cover 610 may include a plastic material to electrically and physically protect the inverter 600.

Hereinafter, the lamp socket 315 according to one or more exemplary embodiments of the present invention will be described with reference to FIGS. 3 to 6.

Figure 3:
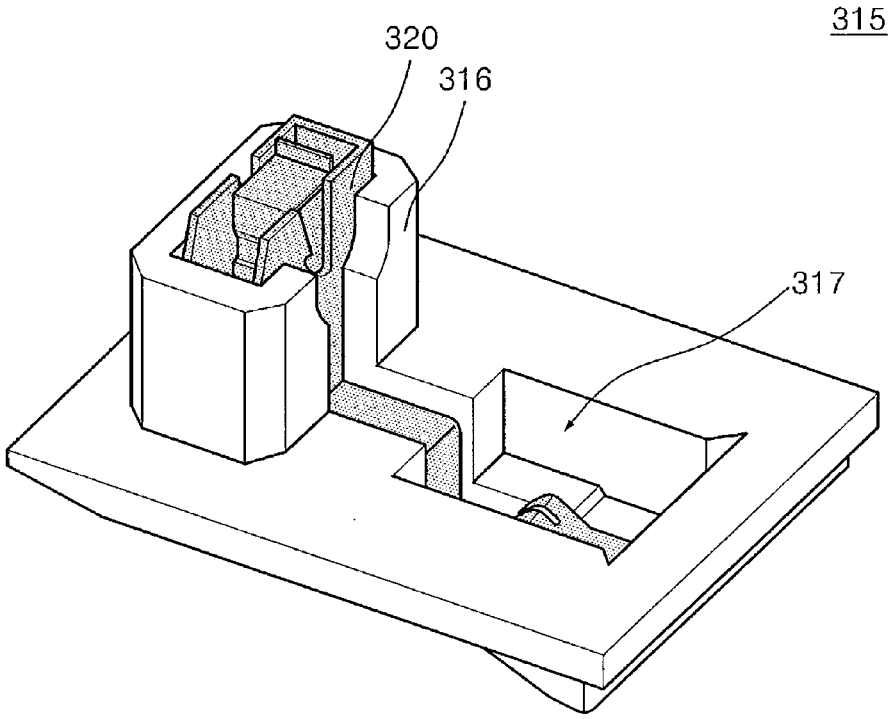
FIG. 3 is a perspective view showing a lamp socket according to one or more exemplary embodiments of the present invention.
Figure 5:
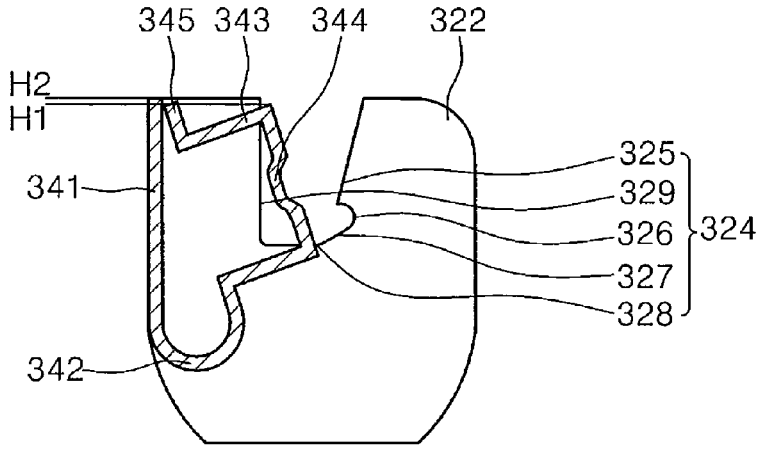
FIG. 5 is a cross-sectional view of a power transmitting member of the lamp socket shown in FIG. 3.
Figure 6:
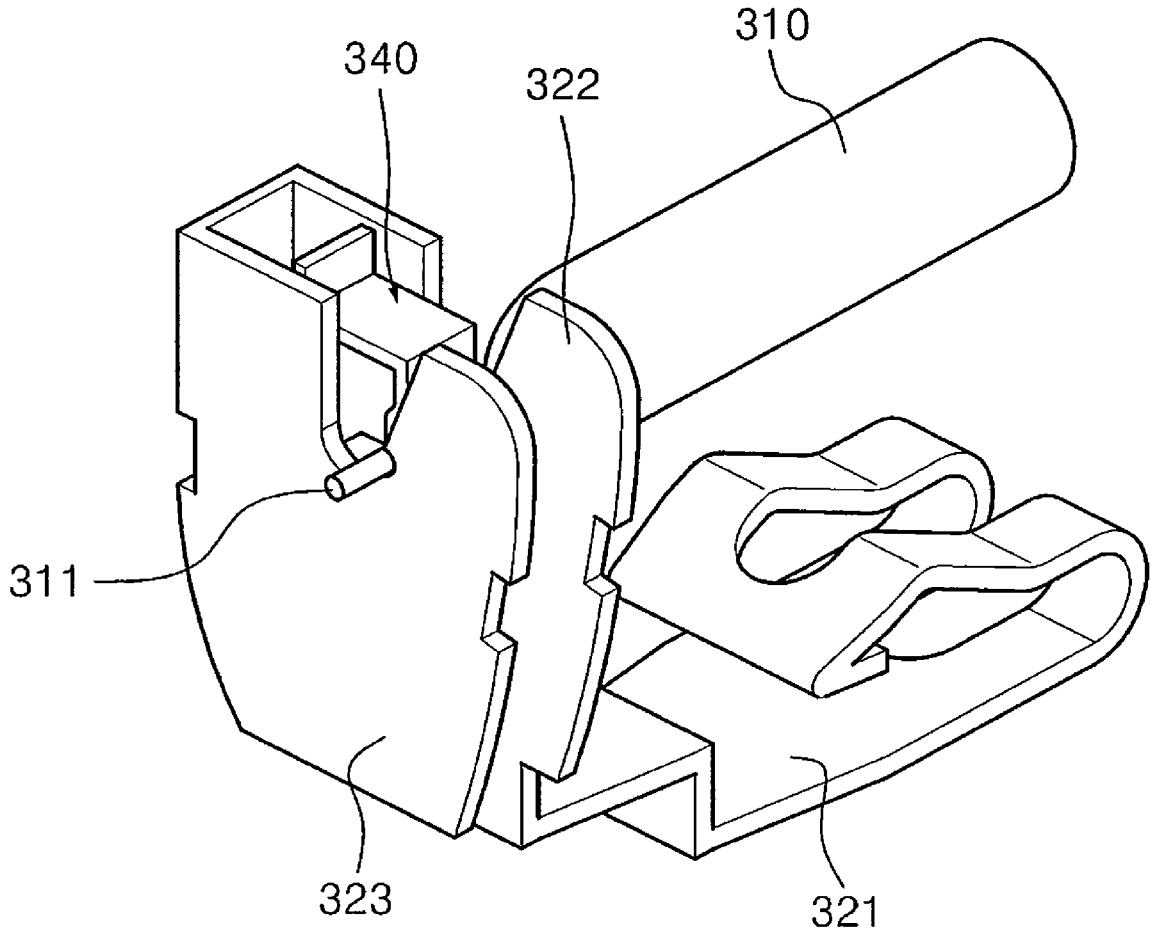
FIG. 6 is a perspective view showing a lamp and a lamp electrode inserted into the power transmitting member of the lamp socket shown in FIG. 3.

FIG. 3 is a perspective view showing a lamp socket according to one or more exemplary embodiments of the present invention; FIG. 4 is a cross-sectional view of a power transmitting member and a housing of the lamp socket shown in FIG. 3; FIG. 5 is a cross-sectional view of a power transmitting member of the lamp socket shown in FIG. 3; and FIG. 6 is a perspective view showing a lamp and a lamp electrode inserted into the the power transmitting member of the lamp socket shown in FIG. 3.

Referring to FIGS. 3 to 6, the lamp socket 315 may include a housing 316 and a power transmitting member 320.

The housing 316 receives the power transmitting member 320 and may be inserted into the coupling hole 510 of the bottom chassis 500 of FIG. 1. To this end, the housing 316 may include a recess 317 that receives the power transmitting member 320.

The power transmitting member 320 may include a conductive material and may be used to electrically connect the inverter 600 of FIG. 1 with the lamps 310. The power transmitting member 320 may include an inverter connector 321, a first lamp electrode supporter 322, a second lamp electrode supporter 323, and an terminal unit 340.

The inverter connector 321 may extend toward the inverter 600 along the recess 317. The inverter connector 321 may have a multi-step structure corresponding to the structure of the recess 317 and a part of the inverter connector 321 may be folded. In addition, a hole may be formed in a predetermined portion of the inverter connector 321. The folding part of the inverter connector 321 has elasticity, so that the inverter 600 may be prevented from being damaged when the inverter connector 321 is connected to the inverter 600.

The first lamp electrode supporter 322 may be connected to the inverter connector 321 and may be vertically accommodated in the recess 317. In addition, the first lamp electrode supporter 322 may have a lamp electrode receiving section 324 into which a lamp electrode 311 is inserted.

The lamp electrode receiving section 324 may be formed at one side of the first lamp electrode supporter 322 and may include an insertion guide 325, a fixing groove 326, a support slope 327, a first support section 328, and a second support section 329. The insertion guide 325 may be inclined such that the lamp electrode 311 may be easily inserted into the lamp electrode receiving section 324 from the upper portion of the first lamp electrode supporter 322 and may be securely accommodated in the lamp electrode receiving section 324. The fixing groove 326 may be connected to the insertion guide 325 and may have a size corresponding to a diameter of the lamp electrode 311. The fixing groove 326 serves as a locking protrusion together with the insertion guide 325 to prevent the lamp electrode 311 from being separated from the lamp electrode receiving section 324. The support slope 327 may be connected to the fixing groove 326 and provides a movement path for the lamp electrode 311 such that the lamp electrode 311 may move while adhering to the fixing groove 326. In addition, the support slope 327 allows the lamp electrode 311 to be easily separated from the fixing groove 326. The first support section 328 may horizontally extend from and be connected to the support slope 327. The first support section 328 provides a margin space so that the lamp electrode 311 may be easily separated from the lamp electrode receiving section 324. The second support section 329 may vertically extend from the first support section 328 and, together with the insertion guide 325, may form an insertion hole into which the lamp electrode 311 is inserted.

The second lamp electrode supporter 323 may face the first lamp electrode supporter 322 so that the terminal unit 340 may be interposed between the first lamp electrode supporter 322 and the second lamp electrode supporter 323 as shown in FIG. 6. Structurally, the second lamp electrode supporter 323 may be substantially identical to the first lamp electrode supporter 322. Hence, similar to the first lamp electrode supporter 322, the second lamp electrode supporter 323 may be formed with a lamp electrode receiving section 324. Detailed description of the second lamp electrode supporter 323 will be omitted in order to avoid redundancy.

The terminal unit 340 may be interposed between the first lamp electrode supporter 322 and the second lamp electrode supporter 323 so as to connect the first lamp electrode supporter 322 to the second lamp electrode supporter 323. The terminal unit 340 may be formed in the housing 316 and a part of the terminal unit 340 may be bent several times in the housing 316. The terminal unit 340 elastically supports the lamp electrode 311 such that the lamp electrode 311 adheres to the fixing groove 326. The terminal unit 340 may be protected by the first lamp electrode supporter 322 and the second lamp electrode supporter 323, so that the terminal unit 340 may be prevented from being damaged by external impact and assembling work for the terminal unit 340 may be reliably and conveniently achieved.

The terminal unit 340 may have a contact pressure of about 1N (Newtons) to about 5N (Newtons) relative to the lamp electrode 311. If the terminal unit 340 has contact pressure less than 1N, the terminal unit 340 may not securely adhere to the lamp electrode 311 so that the power may not be reliably supplied. In contrast, if the terminal unit 340 has contact pressure above 5N, a great amount of force is necessary to insert the lamp electrode 311, so that working efficiency is degraded.

The terminal unit 340 may include a fixed terminal 341, a connection terminal 342, and a free-end terminal 343.

The fixed terminal 341 may be fixed and positioned between the first lamp electrode supporter 322 and the second lamp electrode supporter 323, thereby connecting the first lamp electrode supporter 322 to the second lamp electrode supporter 323.

The connection terminal 342 may be connected to the fixed terminal 341 and may be bent in the housing 316 to provide elastic force. The connection terminal 342 may not extend beyond the front ends of the first lamp electrode supporter 322 and the second lamp electrode supporter 323. The connection terminal 342 may be protected by the first lamp electrode supporter 322 and the second lamp electrode supporter 323. The connection terminal 342 may have a predetermined curvature such that the connection terminal 342 may have a contact pressure of about 1N to about 5N. For instance, the connection terminal 342 may have a radius of curvature of about 0.3 mm to 1.0 mm.

The free-end terminal 343 may be connected to the connection terminal 342 and may make contact with the lamp electrode 311. The free-end terminal 343 may also be formed such that the free-end terminal 343 may be protected from external impacts. For instance, the highest point H1 of the free-end terminal 343 may not be higher than the highest point H2 of the fixed terminal 341. As shown in FIG. 5, the highest point H1 of the free-end terminal 343, which is obtained by taking the horizontal movement of the free-end terminal 343 into consideration, is located below the highest point H2 of the fixed terminal 341.

The free-end terminal 343 supports the lamp electrode 311 and, together with the lamp electrode receiving section 324, fixes the lamp electrode 311 in place. The free-end terminal 343 may include a lamp grip section 344 formed at a region where the free-end terminal 343 makes contact with the lamp electrode 311. For instance, the lamp grip section 344 may be prepared in the form of a recess positioned to oppose the fixing groove 326 of the lamp electrode receiving section 324 and to surround a part of the lamp electrode 311. The free-end terminal 343 may effectively support the lamp electrode 311 such that the lamp electrode 311 is adhered to the fixing groove 326.

The free-end terminal 343 may further include an interval adjuster 345 connected to the lamp grip section 344. The interval adjuster 345 may be formed by bending a tip of the free-end terminal 343. In addition, the interval adjuster 345 may be positioned below the highest point H2 of the fixed terminal 341 to achieve structural stability.

As external force is applied to the interval adjuster 345, the interval adjuster 345 is moved, so that an interval between the free-end terminal 343 and the insertion guide 325 may be adjusted. For instance, if the interval adjuster 345 is moved to the left by the external force, the lamp grip section 344 of the free-end terminal 343 is correspondingly moved in the left direction. As a result, the interval between the insertion guide 325 and the lamp grip section 344 is expanded, so that the lamp electrode 311 may be more easily inserted into or separated from the lamp electrode receiving section 324. In addition, automated assembling work may be facilitated by using the interval adjuster 345.

In the present exemplary embodiment of the invention, an upper end portion of the lamp socket 315 may be positioned below an upper end portion of the lamp 310 such that the lamp socket 315 may be used for a thin display apparatus.

Hereinafter, a method of assembling a lamp according to one or more exemplary embodiments of the present invention will be described with reference to FIG. 7.

Figure 7:
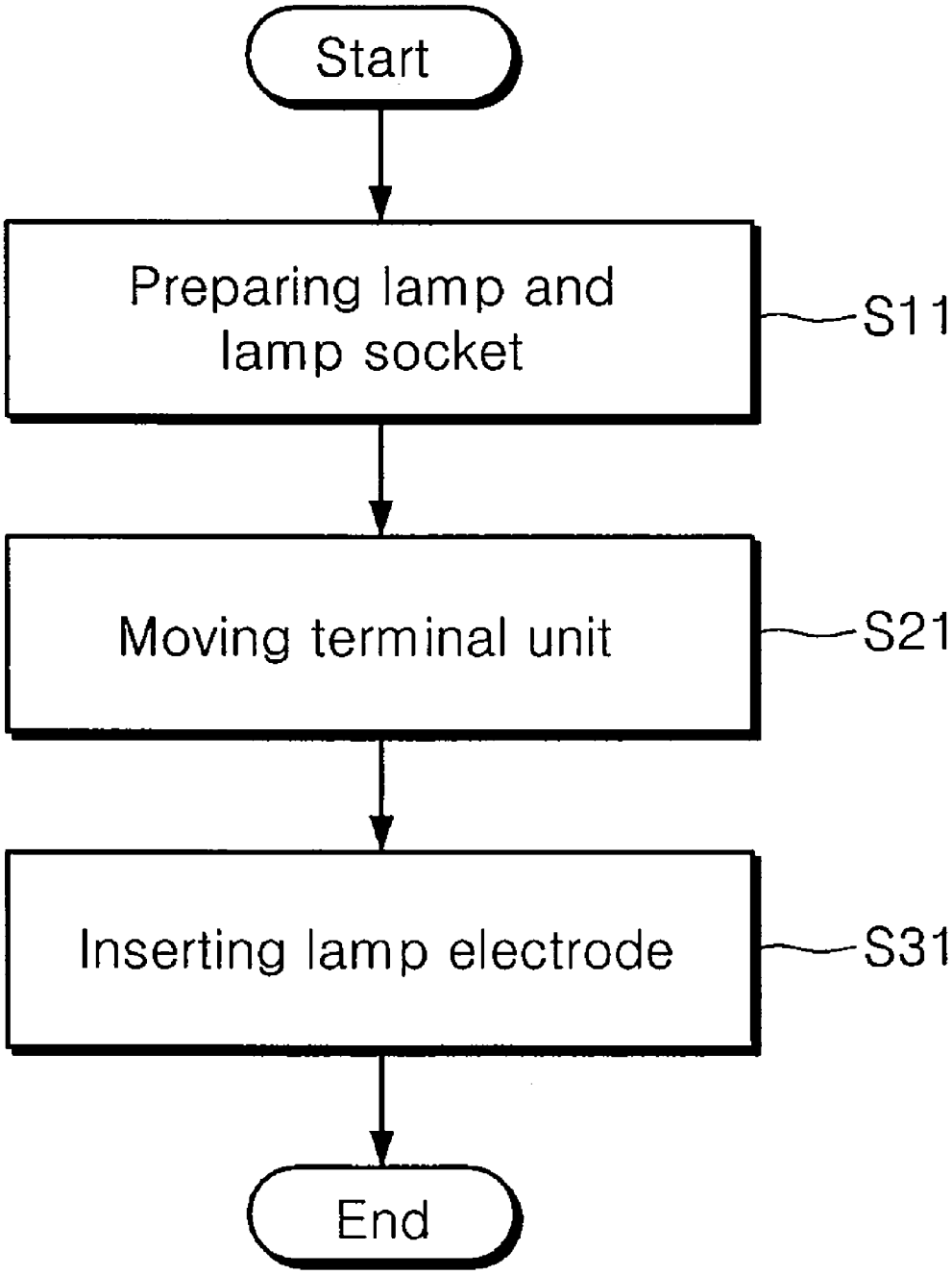
FIG. 7 is a flowchart illustrating a method of assembling a lamp according to one or more exemplary embodiments of the present invention.

FIG. 7 is a flowchart illustrating a method of assembling the lamp according to one or more exemplary embodiments of the present invention.

Referring to FIG. 7, the method of assembling the lamp may include various steps such as: preparing a lamp and a lamp socket (step S11), expanding an interval between an terminal unit and a lamp electrode receiving section (step S21), and inserting a lamp electrode (step S31).

In step S11, the lamp having the lamp electrode and the lamp socket that supplies power to the lamp are prepared. The lamp socket may include a housing and a power transmitting member accommodated in the housing. The power transmitting member may be obtained by processing a conductive plate. The power transmitting member may include an inverter connector, a lamp electrode supporter having a lamp electrode receiving section, and an terminal unit having a fixed terminal, a free-end terminal, and a connection terminal, and the free-end terminal includes an interval adjuster. The lamp electrode receiving section may be prepared in the form of a recess formed at one side of the lamp electrode supporter. The lamp electrode receiving section may include an insertion guide that is inclined by a predetermined angle, a fixing groove connected to the insertion guide and having a semicircular shape corresponding to a diameter of the lamp electrode, and a support slope connected to the fixing groove.

In step S21, the free-end terminal of the terminal unit is moved by moving the interval adjuster of the terminal unit such that an interval between the free-end terminal and the lamp electrode receiving section, into which the lamp electrode is inserted, may be expanded. The interval adjuster of the terminal unit may be moved by using a first jig of an assembling apparatus. At this time, the interval adjuster may be moved toward the fixed terminal such that the free-end terminal is moved away from the lamp electrode receiving section. After that, the interval adjuster may be held fixed by using the first jig, thereby maintaining the expanded interval between the free-end terminal and the lamp electrode receiving section.

In step S31, the lamp electrode is inserted into the lamp electrode receiving section and the power transmitting member is attached to the lamp electrode. A second jig of the assembling apparatus may pick up the lamp such that the lamp electrode may be positioned close to the lamp electrode receiving section. Then, the lamp may be moved by the second jig such that the lamp electrode may be inserted into the lamp electrode receiving section along the insertion guide. After that, the second jig may be separated from the lamp. In addition, the first jig may be separated from the interval adjustor so that the free-end terminal may make contact with the lamp electrode due to the elasticity of the connection terminal. The lamp electrode may adhere to the fixing groove along the support slope.

According to the above exemplary embodiments of the present invention, the lamp socket is made thin so that the thickness of the display apparatus may be reduced. In addition, the lamp electrode does not protrude, thereby preventing the display apparatus from being physically or electrically damaged by external impacts.

Furthermore, because the terminal unit is interposed between the two electrode supporters in the lamp socket and the display apparatus having the lamp socket, a curvature section of the terminal unit is prevented from being damaged by an assembling tool when the lamp is assembled, so that the structural stability of the display apparatus may be ensured. In addition, the lamp electrode may be easily affixed to or removed from the lamp socket, so that assembling work for the lamp may be reliably and conveniently performed.

Although exemplary embodiments of the present invention have been described, it is understood that embodiments of the present invention should not be limited to these exemplary embodiments, but various changes and modifications may be made by one of ordinary skill in the art and be included within the spirit and scope of the present invention as hereinafter claimed.

What is claimed is:

1. A lamp socket comprising:

a power transmitting member comprising a conductive material and supplying a power to a lamp electrode; and a housing receiving the power transmitting member, wherein the power transmitting member comprises;

an inverter connector;

a first lamp electrode supporter connected to the inverter connector and comprising a lamp electrode receiving section into which the lamp electrode is inserted; and an terminal unit comprising a fixed terminal connected to the first lamp electrode supporter, a free-end terminal supporting the lamp electrode to be adhered to the lamp electrode receiving section, and a connection terminal that connects the fixed terminal to the free-end terminal in the housing.

2. The lamp socket as claimed in claim 1, wherein a highest point of the free-end terminal is located below a highest point of the fixed terminal.

3. The lamp socket as claimed in claim 2, wherein the connection terminal is bent in the housing to connect the fixed terminal to the free-end terminal.

4. The lamp socket as claimed in claim 2, wherein the lamp electrode receiving section comprises:

an insertion guide that guides the lamp electrode when the lamp electrode is inserted into the lamp electrode receiving section;

a fixing groove connected to the insertion guide and comprising a curvature section corresponding to a diameter of the lamp electrode; and a slope connected to the fixing groove to support the lamp electrode.

5. The lamp socket as claimed in claim 4, wherein the terminal unit further comprises an interval adjuster positioned at a tip of the free-end terminal to adjust an interval between the free-end terminal and the insertion guide.

6. The lamp socket as claimed in claim 1, wherein the free-end terminal comprises a lamp grip section that makes contact with the lamp electrode while surrounding the lamp electrode.

7. The lamp socket as claimed in claim 1, wherein the power transmitting member further comprises a second lamp electrode supporter that is spaced apart from the first lamp electrode supporter and formed with the lamp electrode receiving section.

8. A display apparatus comprising:

a display panel displaying an image;

a backlight assembly comprising a lamp supplying light to the display panel, and a lamp socket that supplies a power to a lamp electrode and the lamp being fixed to the lamp socket; and a chassis receiving the backlight assembly, wherein the lamp socket comprises:

a power transmitting member; and a housing receiving the power transmitting member, and wherein the power transmitting member comprises:

an inverter connector;

a first lamp electrode supporter connected to the inverter connector and comprising a lamp electrode receiving section into which the lamp electrode is inserted; and an terminal unit comprising a fixed terminal connected to the first lamp electrode supporter, a free-end terminal supporting the lamp electrode to be adhered to the lamp electrode receiving section, and a connection terminal that connects the fixed terminal to the free-end terminal in the housing.

9. The display apparatus as claimed in claim 8, wherein a highest point of the free-end terminal is located below a highest point of the fixed terminal.

10. The display apparatus as claimed in claim 9, wherein the connection terminal is bent in the housing to connect the fixed terminal to the free-end terminal.

11. The display apparatus as claimed in claim 9, wherein the lamp electrode receiving section comprises:

an insertion guide that guides the lamp electrode when the lamp electrode is inserted into the lamp electrode receiving section;

a fixing groove connected to the insertion guide and comprising a curvature section corresponding to a diameter of the lamp electrode; and a slope connected to the fixing groove to support the lamp electrode.

12. The display apparatus as claimed in claim 11, wherein the terminal unit further comprises an interval adjuster positioned at a tip of the free-end terminal to adjust an interval between the free-end terminal and the insertion guide.

13. The display apparatus as claimed in claim 8, wherein the free-end terminal comprises a lamp grip section that makes contact with the lamp electrode while surrounding the lamp electrode.

14. The display apparatus as claimed in claim 8, wherein the power transmitting member further comprises a second lamp electrode supporter that is spaced apart from the first lamp electrode supporter and formed with the lamp electrode receiving section.

15. The display apparatus as claimed in claim 8, wherein the chassis comprises a coupling hole into which the lamp socket is inserted.

16. A method of assembling a lamp to achieve automated assembling of the lamp with a lamp socket, the method comprising:

preparing the lamp provided at an outer portion thereof with a lamp electrode and the lamp socket comprising a housing and a power transmitting member accommodated in the housing, in which the power transmitting member comprises an inverter connector, a lamp electrode supporter formed with a lamp electrode receiving section, and an terminal unit comprising a fixed terminal, a free-end terminal, and a connection terminal;

moving the terminal unit to expand an interval between the terminal unit and the lamp electrode receiving section; and inserting the lamp electrode into the lamp electrode receiving section and elastically moving the terminal unit such that the terminal unit makes contact with the lamp electrode.

17. The method as claimed in claim 16, wherein a highest point of the free-end terminal is located below a highest point of the fixed terminal.

18. The method as claimed in claim 17, wherein the terminal unit further comprises an interval adjuster formed at a tip of the free-end terminal.

19. The method as claimed in claim 18, wherein the interval adjuster is moved and fixed by a jig such that an interval between the free-end terminal and the lamp electrode receiving section is expanded.

20. The method as claimed in claim 17, wherein the connection terminal applies elastic force to the free-end terminal such that the free-end terminal makes contact with the lamp electrode to support the lamp electrode.

* * * * *